US009659467B1

(12) United States Patent
Heckler

(10) Patent No.: US 9,659,467 B1
(45) Date of Patent: May 23, 2017

(54) CASH DRAWER

(71) Applicant: Hecktech, Inc., Phoenix, AZ (US)

(72) Inventor: Dean Heckler, Phoenix, AZ (US)

(73) Assignee: Hecktech, Inc., Phoenix, AZ (US)

( * ) Notice: Subject to any disclaimer, the term of this patent is extended or adjusted under 35 U.S.C. 154(b) by 46 days.

(21) Appl. No.: 14/446,143

(22) Filed: Jul. 29, 2014

(51) Int. Cl.
*G07D 11/00* (2006.01)
*G07G 1/00* (2006.01)

(52) U.S. Cl.
CPC ..... *G07G 1/0027* (2013.01)

(58) Field of Classification Search
CPC ..... G07G 1/0027; G07G 1/0018; G07G 1/00
USPC ..... 235/7 R, 7 A, 22
See application file for complete search history.

(56) References Cited

U.S. PATENT DOCUMENTS

| | | | | |
|---|---|---|---|---|
| D248,793 | S | 8/1978 | Ross | |
| 4,412,709 | A | 11/1983 | Ishii | |
| 4,436,989 | A | 3/1984 | Schuldt | |
| 4,637,326 | A | 1/1987 | Baitz | |
| D296,949 | S | 7/1988 | Warwicker | |
| 4,786,785 | A | 11/1988 | Felt | |
| 5,451,753 | A | 9/1995 | Leatherwood | |
| 5,723,850 | A | 3/1998 | Lambert | |
| 5,756,977 | A * | 5/1998 | Biss | 235/7 R |
| 5,768,965 | A | 6/1998 | Gonzalez | |
| 5,829,673 | A | 11/1998 | Harr | |
| D437,876 | S | 2/2001 | Davies | |
| 7,059,513 | B2 | 6/2006 | Daugs | |
| 7,533,797 | B2 | 5/2009 | Stulz | |
| 8,317,083 | B2 | 11/2012 | Specht | |
| 2001/0032790 | A1* | 10/2001 | Carter | 206/0.81 |
| 2003/0136825 | A1 | 7/2003 | Bletzinger | |
| 2009/0101724 | A1* | 4/2009 | Byerley | 235/7 R |
| 2014/0311305 | A1* | 10/2014 | Richards | 83/13 |

* cited by examiner

*Primary Examiner* — Allyson Trail
(74) *Attorney, Agent, or Firm* — Hartman Titus PLC; John D. Titus

(57) ABSTRACT

A cash drawer for use in mobile POS and other retail environments includes a plurality of coin bins that are positioned uniformly around the geometric center of the cash drawer. This unique arrangement eliminates the need for counterweights to prevent the drawer from tipping when opened. Bins for storing paper currency are disposed laterally outward from the coin bins and are canted outward so that the paper currency lies at an angle relative to the floor of the cash drawer rather than lying flat as in a conventional cash drawer. This enables the width of the drawer also to be reduced significantly.

10 Claims, 5 Drawing Sheets

CASH DRAWER

BACKGROUND OF THE INVENTION

This invention relates generally to point-of-sale (POS) equipment and, in particular to cash drawers used for storing coins, currency, checks, receipts and the like involved in a retail sales transaction.

Point of Sale (POS) equipment has existed since at least the late 1800s when the first mechanical cash register was introduced. The mechanical cash register was a breakthrough in its day because not only did it correctly add-up the total for individual transactions during the day, it also kept a running tally of the transactions, which to enabled the merchant to reconcile the transactions with the receipts in the cash drawer. In the 1970s, introduction of the barcode scanner and universal product code (UPC) along with the general purpose computer enabled merchants to process transactions more efficiently and more accurately, as well as enabling them to track inventory more accurately.

Dedicated POS systems are robust and powerful, however, for many small businesses they are simply too costly and too bulky. Consequently, for many small and even medium-sized businesses, dedicated POS systems are giving way to tablet-based mobile POS systems. In a tablet-based mobile POS system, a tablet computer such as an Apple® iPad® is equipped with a card-swipe device, credit card chip-reading device or similar interface to receive credit card information from the purchaser. When a purchase is made, the customer's credit card information is received and transmitted to the payment processor where the transaction is approved and the credit card charged. A receipt printer, which may be connected wirelessly or via Ethernet cable to the tablet computer, then prints the receipt for the customer.

Despite the convenience of credit card transactions, many consumers still prefer to make purchases with cash or check. Consequently, the need remains for a cash drawer to hold coins, paper currency, checks and the like in a tablet-based mobile POS environment. In a mobile POS environment, however, there is no dedicated cashier's station. Consequently, the cash drawer is often simply placed on a table, usually with a security cable attached to prevent theft. Prior art cash drawers have always been arranged with the coin bins along the front edge and the currency bins behind. This presents no problem if the cash drawer is permanently installed in a cashier's station or is integrated into a traditional heavy cash register, but if the cash drawer is simply placed on a table, the heavy coins in front will cause the cash drawer to tip forward when the drawer extends out of the housing. Consequently, some prior art POS cash drawers include heavy counterweights behind the paper currency bins to offset the anticipated weight of the coins in the coin bins, so that the cash drawer does not tip forward when opened. Not only does this solution add unnecessary weight to the cash drawer, it also adds additional volume necessary to accommodate the counterweights.

What is needed, and what the prior art does not provide therefore, is a compact cash drawer in which the coin bins and the paper currency bins are arranged in a unique manner so that the drawer is balanced when open and therefore does not require counterweights to prevent the drawer from tipping forward when opened.

SUMMARY OF THE INVENTION

The present invention comprises a cash drawer for use in tablet-based mobile POS transactions and other cash transactions. According to an illustrative embodiment, the cash drawer includes a plurality of coin bins that are positioned uniformly around the geometric center of the cash drawer so that at least some of the coin bins are positioned rearward of the centerline of the drawer. This eliminates the need for counterweights, which enables the depth of the cash drawer to be reduced without re-introducing the problem of the drawer tipping when opened. Bins for storing paper currency are disposed laterally outward from the coin bins and are canted outward so that the paper currency lies at an angle relative to the floor of the cash drawer rather than lying flat as in a conventional cash drawer. This enables the width of the drawer also to be reduced significantly.

BRIEF DESCRIPTION OF THE DRAWING

The present invention will be better understood from a reading of the following detailed description, taken in conjunction with the accompanying drawing figures in which like references designate like elements and, in which.

DETAILED DESCRIPTION

Figure 1:
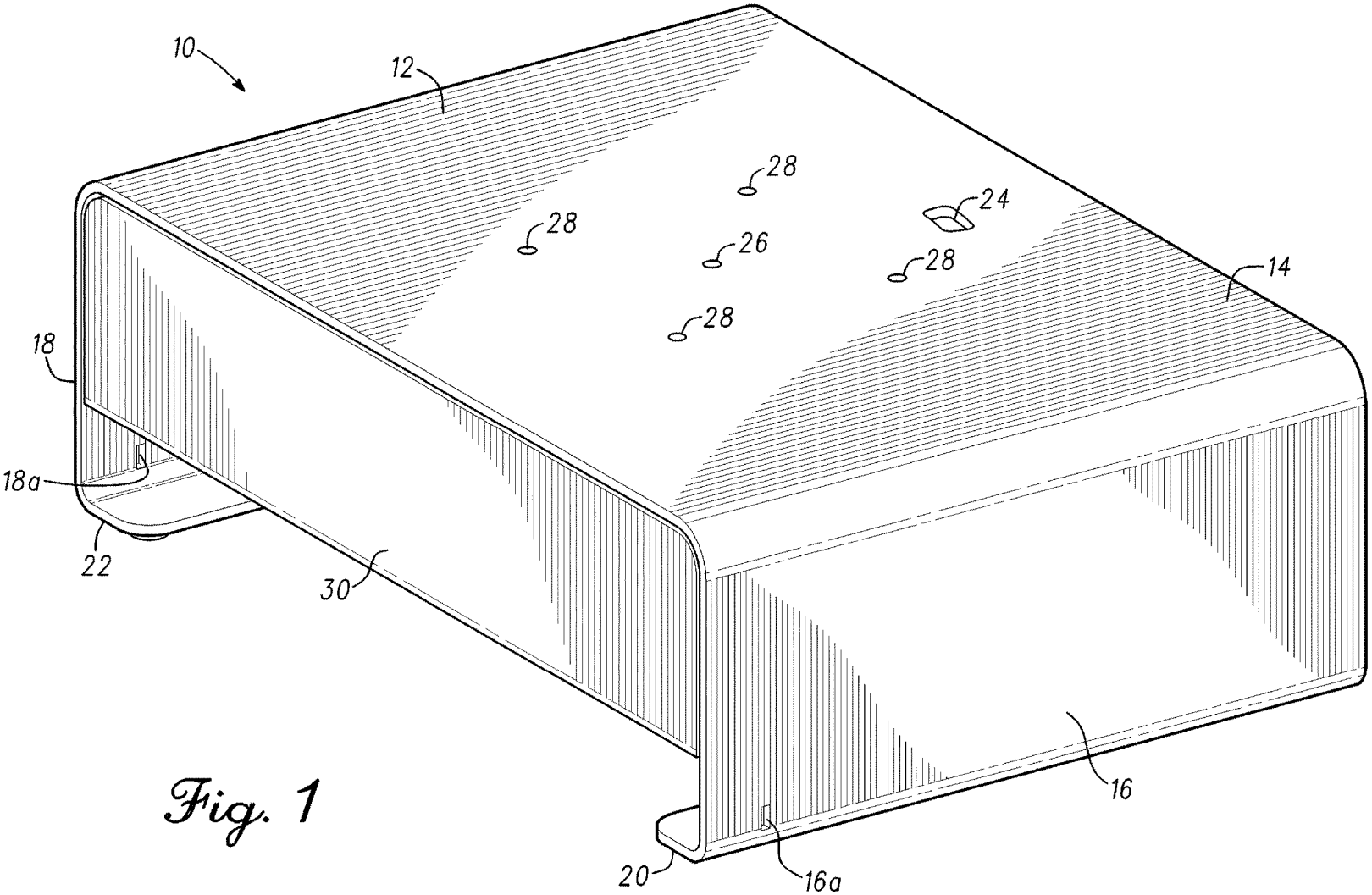
FIG. 1 is a front perspective view of a cash drawer incorporating features of the present invention.

The drawing figures are intended to illustrate the general manner of construction and are not necessarily to scale. In the detailed description and in the drawing figures, specific illustrative examples are shown and herein described in detail. It should be understood, however, that the drawing figures and detailed description are not intended to limit the invention to the particular form disclosed, but are merely illustrative and intended to teach one of ordinary skill how to make and/or use the invention claimed herein and for setting forth the best mode for carrying out the invention.

Figure 2:
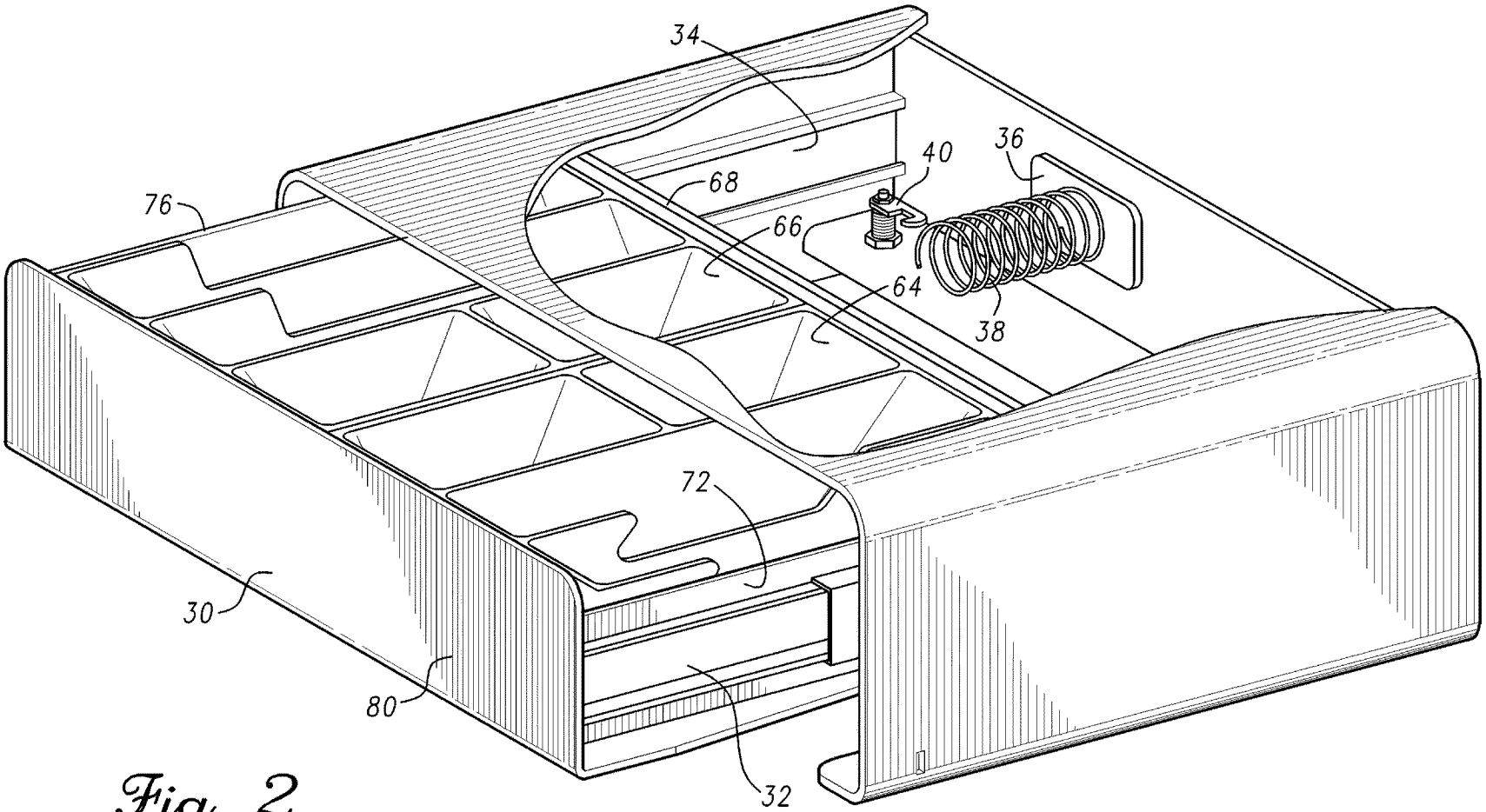
FIG. 2 is a front perspective view of the cash drawer of FIG. 1 partially cut away to reveal the interior.

With reference to the figures and in particular FIGS. 1 and 2, a cash drawer 10 incorporating features of the present invention comprises a housing 12. Housing 12 may be formed of any suitable material but in the illustrative embodiment, housing 12 comprises a sheet of laser-cut steel formed into a top wall 14, two lateral walls 16, 18 and two lower walls 20, 22. Lateral walls 16, 18 may include slots 16*a* and 18*a* to accept a cable security lock such as a Kensington® cable lock. Upper wall 14 includes a cable opening 24, a pivot opening 26 and mounting holes 28. A drawer assembly 30 is mounted to housing 12 using a pair of heavy-duty drawer glides 32, 34. Drawer assembly 30 may be made of any suitable material, but in the illustrative embodiment drawer assembly 30 also comprises a sheet of laser-cut steel.

Because cash drawer 10 is primarily intended for use in the mobile POS environment, cash drawer 10 is equipped with an electronic drawer kicker 36, which releases drawer assembly 30 in response to an electronic signal produced by the POS receipt printer, tablet computer or other device. When released by the electronic drawer kicker 36, drawer assembly 30 is pushed from a closed position as shown in FIG. 1 into an open position as shown in FIG. 2. Cash drawer 10 is also equipped with a mechanical override 40 which may be manipulated by a conventional key to lock or release drawer assembly 30 as required.

Figure 3:
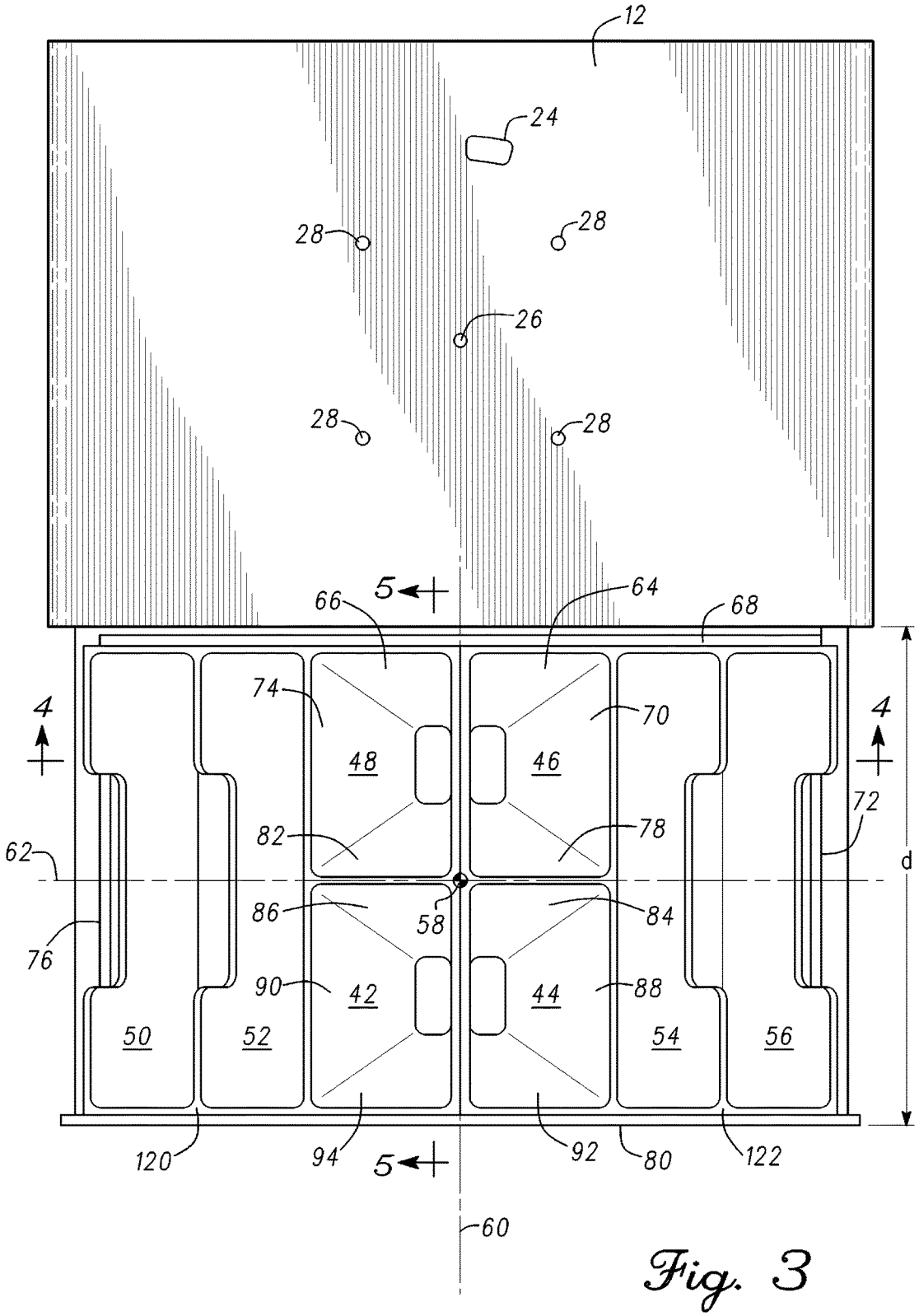
FIG. 3 is a top view of the cash drawer of FIG. 1.

With additional reference to FIG. 3, drawer assembly 30 includes a till that is made up of a plurality of coin bins 42, 44, 46, 48 and currency bins 50, 52, 54 and 56. The coin bins 42, 44, 46, 48 are arranged uniformly around the geometric center 58 of drawer assembly 30, with coin bin 42 in the left front quadrant, coin bin 44 in the right front quadrant, coin bin 46 in the right rear quadrant and coin bin 48 in the left rear quadrant as defined by the longitudinal centerline 60 and the lateral centerline 62 of drawer assembly 30. As a result of this unique configuration, the rear walls 64, 66 of coin bins 46, 48 are immediately adjacent the back wall 68 of drawer assembly 30 and, therefore, heavy coins placed in coin bins 46 and 48 will not cause drawer assembly 30 to become unbalanced and tip forward when open. This eliminates the need for a drawer having a depth dimension greater than dimension "d" of drawer assembly 30 and, importantly, eliminates the need to have counterweights behind the rear wall 68 of drawer assembly 30.

Figure 4:
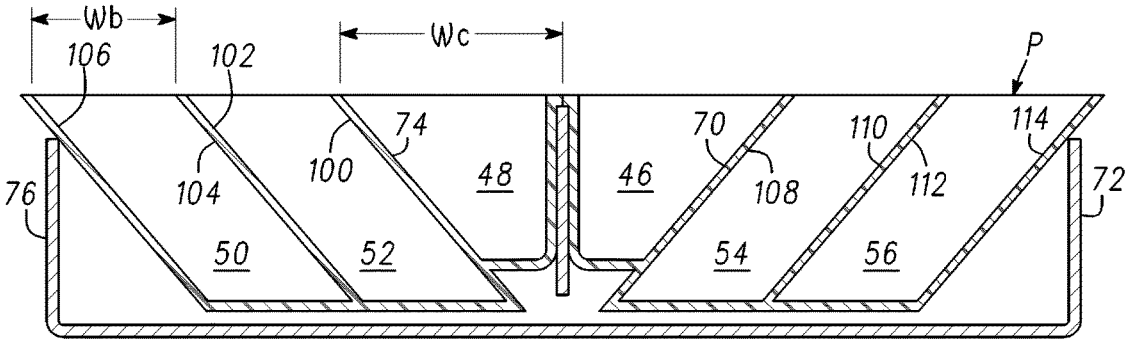
FIG. 4 is a cross-sectional view of the cash drawer trays taken along line 4-4 of FIG. 3.
Figure 5:
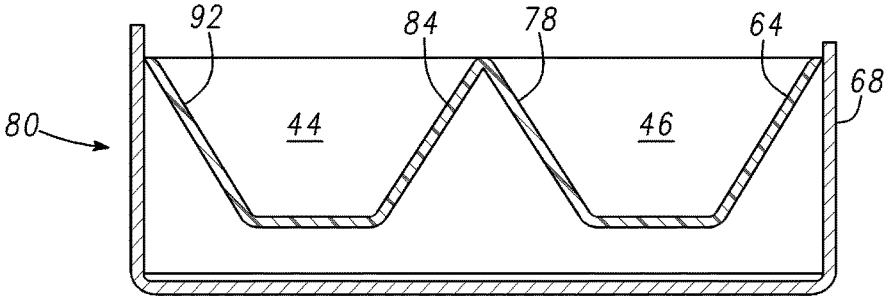
FIG. 5 is a cross-sectional view of one of the cash drawer trays taken along line 5-5 of FIG. 3.

With additional reference to FIGS. 4 and 5, in the illustrative embodiment, coin bin 46 has a sidewall 70 that slopes upward toward right side wall 72 of drawer assembly 30. Similarly, coin bin 48 has a sidewall 74 that slopes upward toward the left side wall 76 of drawer assembly 30. Coin bin 46 also has a front wall 78 that slopes upwards towards from wall 80 of drawer assembly 30. Similarly, coin bin 48 has a front wall 82 that slopes upward toward front wall 80 of drawer assembly 30. The walls 84, 86, 88, 90, 92 and 94 of coin bins 42 and 44 are similarly sloped. This unique arrangement of coin bins allows for ambidextrous removal of coins from coins bin 42, 44, 46, 48. For example, the cashier may remove a coin from coin bin 46 with the right index finger, a coin from coin bin 44 with the right thumb, a coin from coin bin 48 with the left index finger and a coin from coin bin 42 with the left thumb.

With particular reference to FIGS. 3 and 4, currency bins 50, 52, 54, 56 are arranged toward the left and right sides of drawer assembly 30 so that currency bins 54, 56 are positioned between coin bins 44, 46 and right side wall 72; and currency bins 50, 52 are positioned between coin bins 42, 48 and left side wall 76. Currency bins 50, 52, 54, 56 are arranged in a slanted configuration so that the paper currency is stored on an angle as opposed to the currency laying flat as is common in prior art cash drawers. As can be seen in FIG. 4, the inside wall 100 of currency bin 52 is substantially parallel to the sidewall 74 of coin bin 48. The outside wall 102 of currency bin 52 is also substantially parallel to sidewall 74 of currency bin 48. The walls 104, 106 of currency bin 50 are also substantially parallel to sidewall 74 of currency bin 48. The remaining walls 108, 110, 112, 114 of currency bins 54, 56 are similarly substantially parallel to sidewall 70 of currency bin 46. This slanted configuration further reduces the width of the drawer assembly 30 by allowing one denomination of currency to be stored underneath a different denomination of currency in a different bin without in any way impairing the ability of the cashier to select the appropriate bills from the appropriate currency bin since the openings to all of the bins both coin and currency lie in a common plane "P."

Figure 6:
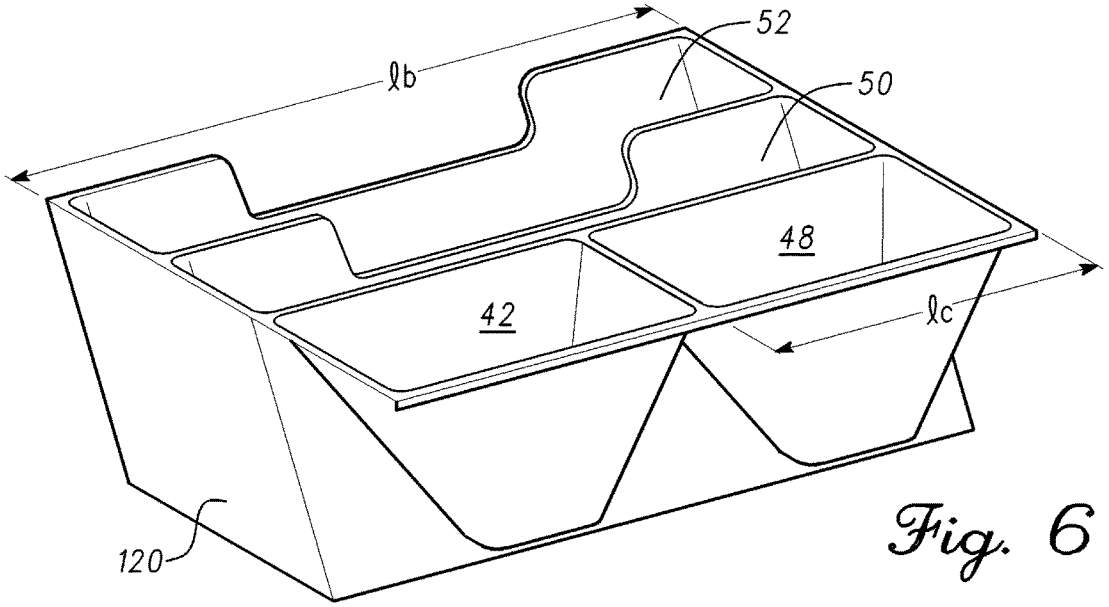
FIG. 6 is a perspective view of one of the cash drawer trays shown in FIG. 1.
Figure 7:
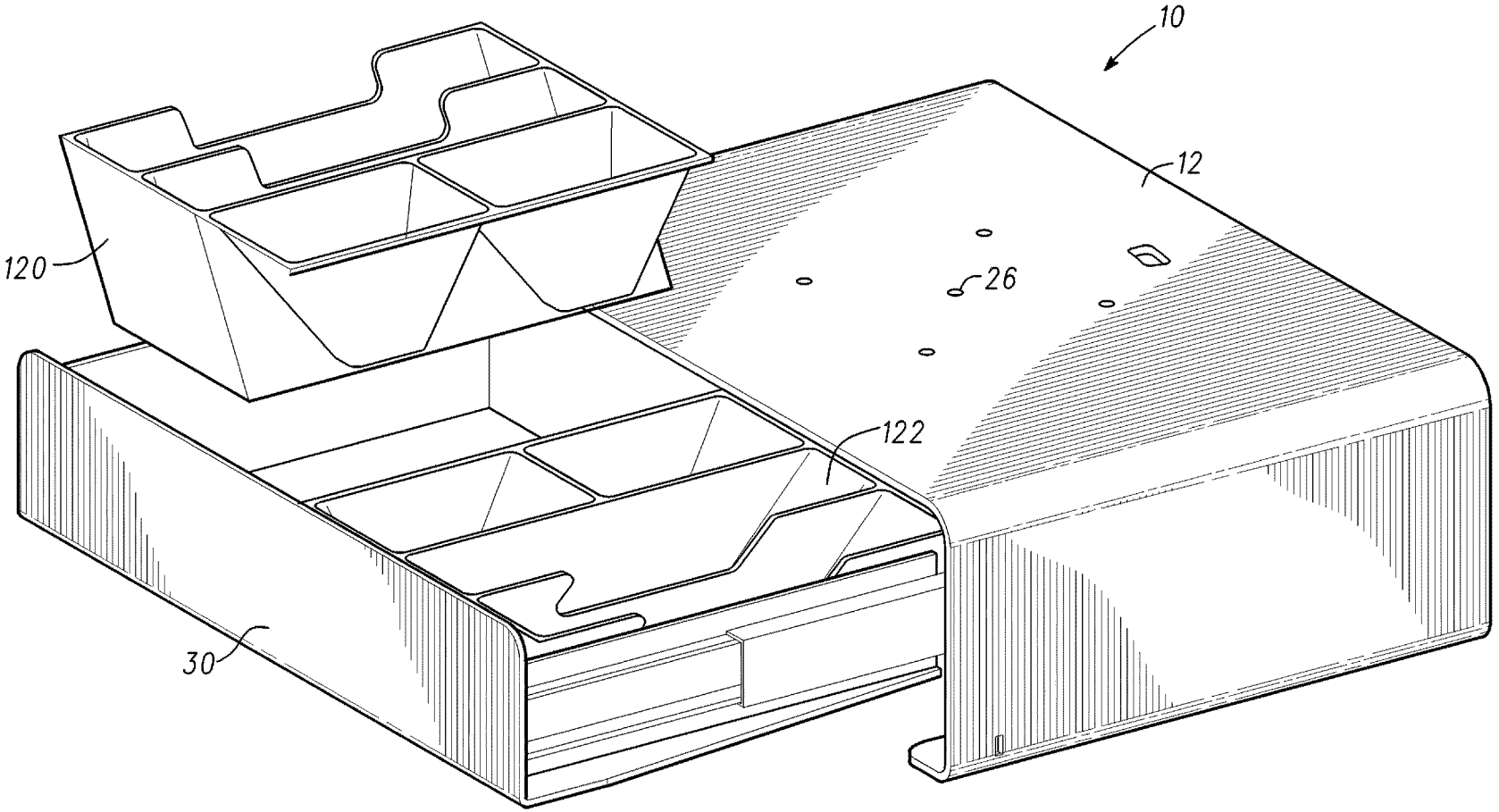
FIG. 7 is a front perspective view of the cash drawer of FIG. 1 with one of the cash drawer trays removed.

With additional reference to FIGS. 6 and 7, currency bins 50, 52 are optimized for handling United States currency and therefore the length "lb" is approximately 6 inches while the width "wb" is approximately 1½ inch. Coin bins 42, 48 are optimized for storing coins within the drawer dimensions and therefore have a length "lc" of approximately 3 inches and a width "wc" of approximately 2½ inches; however the dimensions are scalable to adapt to the currencies of other countries. Although the bins may be integral to the cash drawer assembly 30 in the illustrative embodiment, the bins are preferably fabricated as trays 120, 122 which fit inside a corresponding recess in the drawer assembly 30. Trays 120, 122 may be formed of any suitable material but preferably are molded from a plastic such as polyethylene. Because the bins are formed from two subassemblies, as opposed to a single unitary tray, the walls of currency bins 50, 52 and the walls of currency bins 54 and 56 can be sloped away from each other without making the part difficult to mold due to incompatible mold draft angles.

Although certain illustrative embodiments and methods have been disclosed herein, it will be apparent from the foregoing disclosure to those skilled in the art that variations and modifications of such embodiments and methods may be made without departing from the invention. For example, although the illustrative embodiment depicts a cash drawer for use primarily with mobile POS systems the drawer may be used in connection with any tablet-based or other POS system, or anywhere a cash drawer is necessary or desirable. Similarly, although the illustrative embodiment depicts a cash drawer having an electronic drawer kicker interfaced with the tablet computer, the electronic components may be omitted without departing from the scope of the invention. Accordingly, it is intended that the invention should be limited only to the extent required by the appended claims and the rules and principles of applicable law. Additionally, as used herein, references to direction such as "up" or "down" are intend to be exemplary and are not considered as limiting the invention and, unless otherwise specifically defined, the terms "generally," "substantially," or "approximately" when used with mathematical concepts or measurements mean within ±10 degrees of angle or within 10 percent of the measurement, whichever is greater, and as used herein, a step of "providing" a structural element recited in a method claim means and includes obtaining, fabricating, purchasing, acquiring or otherwise gaining access to the structural element for performing the steps of the method.

What is claimed is:

1. A cash drawer apparatus comprising:

a housing comprising a top wall and two lateral walls;

a drawer assembly movable between a closed position and an open position relative to the housing, the drawer assembly having a front wall, a left side wall and a right side wall, a geometric center, a longitudinal centerline and a lateral centerline, the drawer assembly further comprising a plurality of coin bins and a plurality of currency bins, the plurality of coin bins and the plurality of currency bins having upward-facing openings, the upward-facing openings of the currency bins having dimensions that are longer and narrower than the dimensions of the upward-facing openings of the plurality of coin bins, the drawer assembly characterized in that the plurality of currency bins are adjacent to the plurality of coin bins and at least one of the plurality of coin bins is positioned rearward of the lateral centerline of the drawer assembly.

2. The cash drawer apparatus of claim 1, wherein:

each of the plurality of coin bins is spaced-apart from the left side wall and the right side wall of the drawer assembly.

3. The cash drawer apparatus of claim 2, wherein:
at least one currency bin is disposed between the plurality of coin bins and one of the left and right side walls of the drawer assembly.

4. The cash drawer apparatus of claim 2, wherein:
at least one currency bin is disposed between the plurality of coin bins and the left side wall and at least one currency bin is disposed between the plurality of coin bins and the right side wall of the drawer assembly.

5. The cash drawer apparatus of claim 1, wherein:
the plurality of coin bins comprise a first coin bin having a side wall that is angled upward toward the left side wall and a second coin bin having a side wall that is angled upward toward the right side wall.

6. The cash drawer apparatus of claim 5, wherein:
the plurality of currency bins comprise a first currency bin having a side wall that is substantially parallel to the side wall of the first coin bin and a second currency bin having a side wall that is substantially parallel to the side wall of the second coin bin.

7. The cash drawer apparatus of claim 5, wherein:
the plurality of currency bins comprise a first currency bin having a pair of side walls both of which are is substantially parallel to the side wall of the first coin bin and a second currency bin having a pair of side wall both of which are substantially parallel to the side wall of the second coin bin.

8. A cash drawer apparatus comprising:
a housing comprising a top wall and two lateral walls;
a drawer assembly movable between a closed position and an open position relative to the housing, the drawer assembly having a front wall, a left side wall and a right side wall, a geometric center, a longitudinal centerline and a lateral centerline, the drawer assembly further comprising a plurality of coin bins and a plurality of currency bins, the plurality of coin bins and the plurality of currency bins having upward-facing openings, the upward-facing openings of the currency bins having dimensions that are longer and narrower than the dimensions of the upward-facing openings of the plurality of coin bins, the drawer assembly characterized in that the plurality of coin bins are disposed substantially uniformly about the geometric center of the drawer assembly in four quadrants defined by the longitudinal and lateral centerlines of the drawer assembly.

9. The cash drawer apparatus of claim 8, wherein:
the plurality of coin bins comprise first and second coin bins each having a side wall that is angled upward toward the left side wall, the plurality of coin bins further comprising third and fourth coin bins each having a side wall that is angled upward toward the right side wall.

10. The cash drawer apparatus of claim 8, wherein:
the plurality of coin bins comprise two substantially identical trays positioned in an opposite-facing orientation in the drawer assembly.

* * * * *